US005195501A

United States Patent [19]

Ault

[11] Patent Number: 5,195,501

[45] Date of Patent: Mar. 23, 1993

[54] REFUSE BURNER BARREL APPARATUS

[76] Inventor: John W. Ault, P.O. Box 67, Washington Crossing, Pa. 18977

[21] Appl. No.: 813,602

[22] Filed: Dec. 26, 1991

[51] Int. Cl.[5] ..... F23G 5/00

[52] U.S. Cl. ..... 126/224; 126/147; 110/241

[58] Field of Search ..... 126/244, 151, 147, 145, 126/149, 150; 110/235, 241, 236

[56] References Cited

U.S. PATENT DOCUMENTS

| | | | |
|---|---|---|---|
| 1,372,424 | 3/1921 | Haase | 110/241 |
| 2,035,167 | 3/1936 | Korach | 110/241 |
| 2,299,154 | 10/1942 | Lair | 126/145 |
| 2,424,665 | 7/1947 | Pope, Sr. | 110/241 X |
| 2,538,811 | 1/1951 | Triggs | 110/235 |
| 3,330,232 | 7/1967 | Wagle | 110/241 X |
| 3,498,240 | 3/1970 | Trott | 110/241 X |
| 4,414,956 | 11/1983 | Webber | 126/225 X |
| 4,655,193 | 4/1987 | Blacket | 126/151 X |

FOREIGN PATENT DOCUMENTS

| | | | |
|---|---|---|---|
| 249582 | 9/1961 | Australia | 110/241 |
| 1146220 | 3/1963 | Fed. Rep. of Germany | 110/241 |

*Primary Examiner*—Larry Jones
*Attorney, Agent, or Firm*—Leon Gilden

[57] ABSTRACT

A trash barrel arranged for the burning of refuse therewithin is provided to provide a semi-cylindrical first shell mounting a semi-cylindrical second shell functioning as a door relative to the first shell. A powdered brick aggregate is contained within spaced walls of the first shell, including upper and lower semi-cylindrical caps mounted to upper and lower distal ends of the first shell to enclose the powdered brick aggregate therewithin. The shell structure includes an upper and lower semi-circular "U" shaped channel cap to contain the aggregate within the first shell, with a lower cap including a floor plate integral therewith to accommodate the second shell thereover. The second shell further includes a sliding door to permit drafting through the interior cavity of the first and second shells when in a cylindrical configuration, with a wire-mesh basket mounted to the second shell to be removed relative to the first shell upon opening of the door or second shell structure.

7 Claims, 4 Drawing Sheets

REFUSE BURNER BARREL APPARATUS

BACKGROUND OF THE INVENTION

1. Field of the Invention

The field of invention relates to barrel burning apparatus, and more particularly pertains to a new and improved refuse burner barrel apparatus wherein the same is arranged to provide for a barrel structure including refractory material container therewithin to contain a fire within the barrel structure.

2. Description of the Prior Art

Conventional drums utilized in the burning of refuse are typically full within a limited period of time making them difficult to move for disposal thereof. Further, such prior art drum structure as utilized are subject to rust and the like in their effective life in use. While prior art barrel structure has been addressed in the prior art, such as typified in the U.S. Pat. Nos. 4,525,139 to Beimann; 4,545,758 to Nakamura; 4,789,331 to Kawamura; 4,466,790 to Godijan; and 4,351,316 to Kroll, these patents have typically utilized elaborate and cumbersome structures not availing themselves of ease of manipulation, ease of use, or the economy of parts and manufacture and in this respect, the present invention substantially fulfills this need.

SUMMARY OF THE INVENTION

In view of the foregoing disadvantages inherent in the known types of barrel apparatus now present in the prior art, the present invention provides a refuse burner barrel apparatus wherein the same is arranged to provide for a barrel structure to burn refuse therewithin arranged for ease of cleaning and maintenance of the barrel structure. As such, the general purpose of the present invention, which will be described subsequently in greater detail, is to provide a new and improved refuse burner barrel apparatus which has all the advantages of the prior art barrel apparatus and none of the disadvantages.

To attain this, the present invention includes a trash barrel arranged for the burning of refuse therewithin to provide a semi-cylindrical first shell mounting a semi-cylindrical second shell functioning as a door relative to the first shell. A powdered brick aggregate is contained within spaced walls of the first shell, including upper and lower semi-cylindrical caps mounted to upper and lower distal ends of the first shell to enclose the powdered brick aggregate therewithin. The shell structure includes an upper and lower semi-cylindrical "U" shaped channel cap to contain the aggregate within the first shell, with a lower cap including a floor plate integral therewith to accommodate the second shell thereover. The second shell further includes a sliding door to permit drafting through the interior cavity of the first and second shells when in a cylindrical configuration, with a wire-mesh basket mounted to the second shell to be removed relative to the first shell upon opening of the door or second shell structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved refuse burner barrel apparatus which has all the advantages of the prior art barrel apparatus and none of the disadvantages.

It is another object of the present invention to provide a new and improved refuse burner barrel apparatus which may be easily and efficiently manufactured and marketed.

It is a further object of the present invention to provide a new and improved refuse burner barrel apparatus which is of a durable and reliable construction.

An even further object of the present invention is to provide a new and improved refuse burner barrel apparatus which is susceptible of a low cost of manufacture with regard to both materials and labor, and which accordingly is then susceptible of low prices of sale to the consuming public, thereby making such refuse burner barrel apparatus economically available to the buying public.

Still yet another object of the present invention is to provide a new and improved refuse burner barrel apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
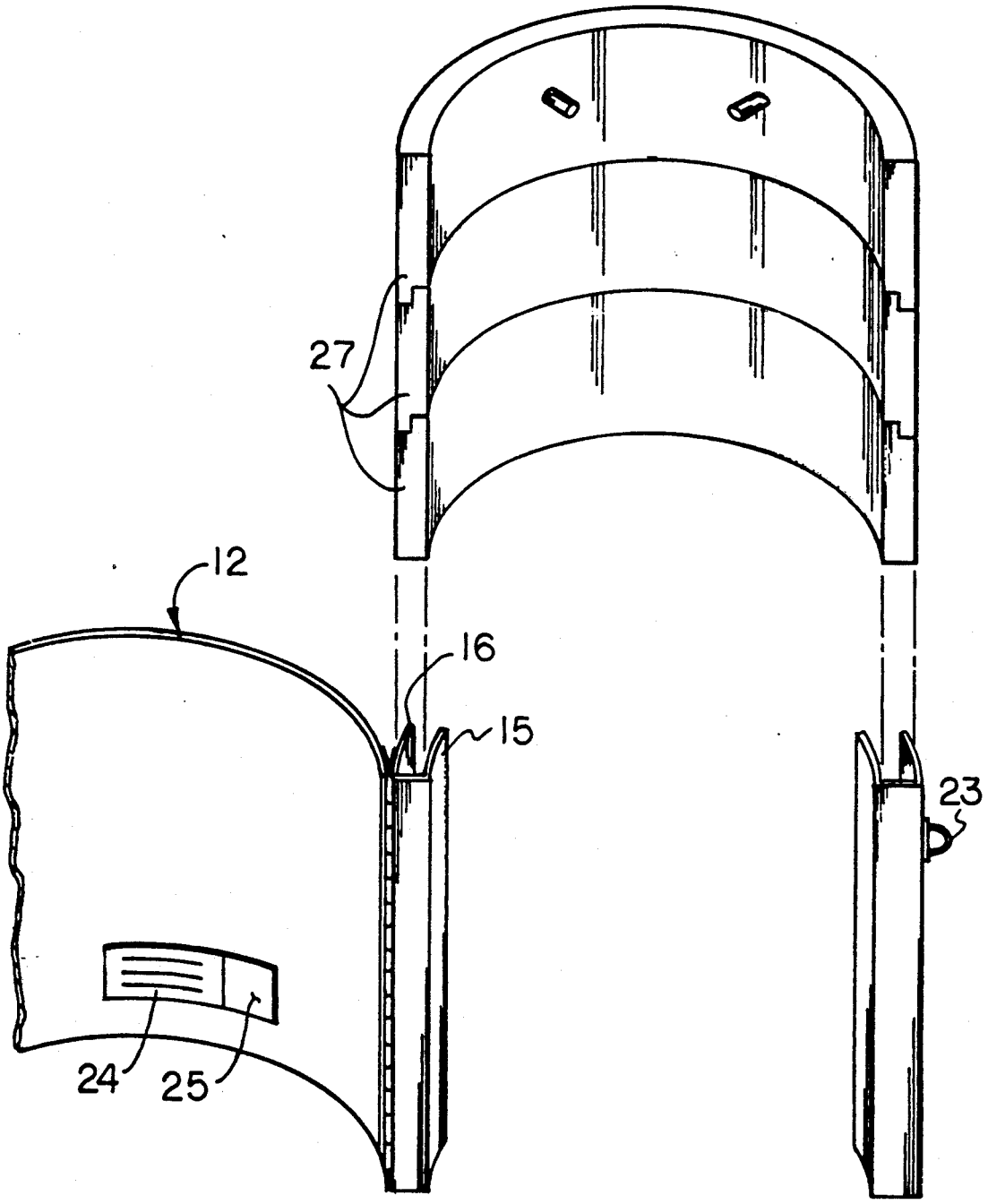
FIG. 1 is an isometric illustration illustrating the first shell pivotally mounted to the second shell incorporating semi-circular cementious inserts.
Figure 2:
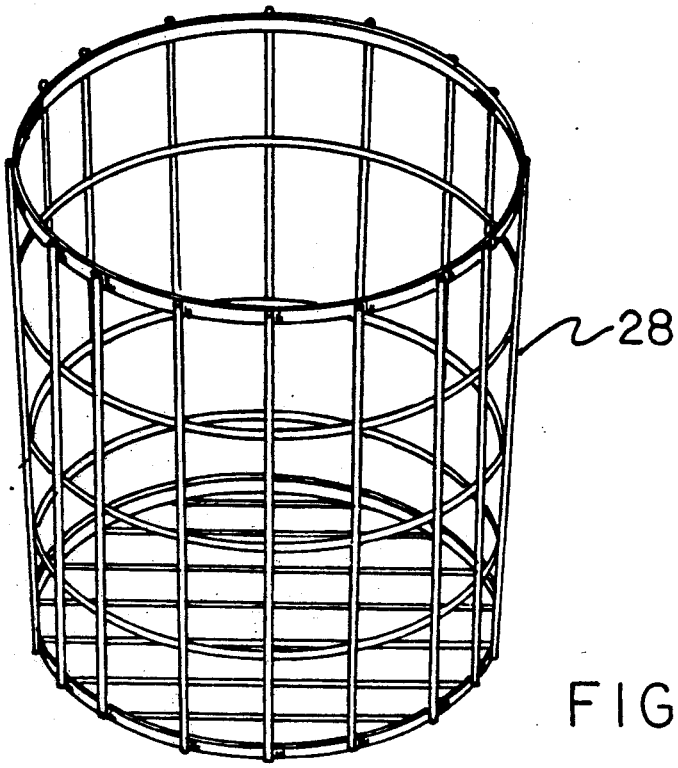
FIG. 2 is an isometric illustration of the mesh basket utilized by the invention.

With reference now to the drawings, and in particular to FIGS. 1 to 5 thereof, a new and improved refuse burner barrel apparatus embodying the principles and concepts of the present invention and generally designated by the reference numeral 10 will be described.

Figure 3:
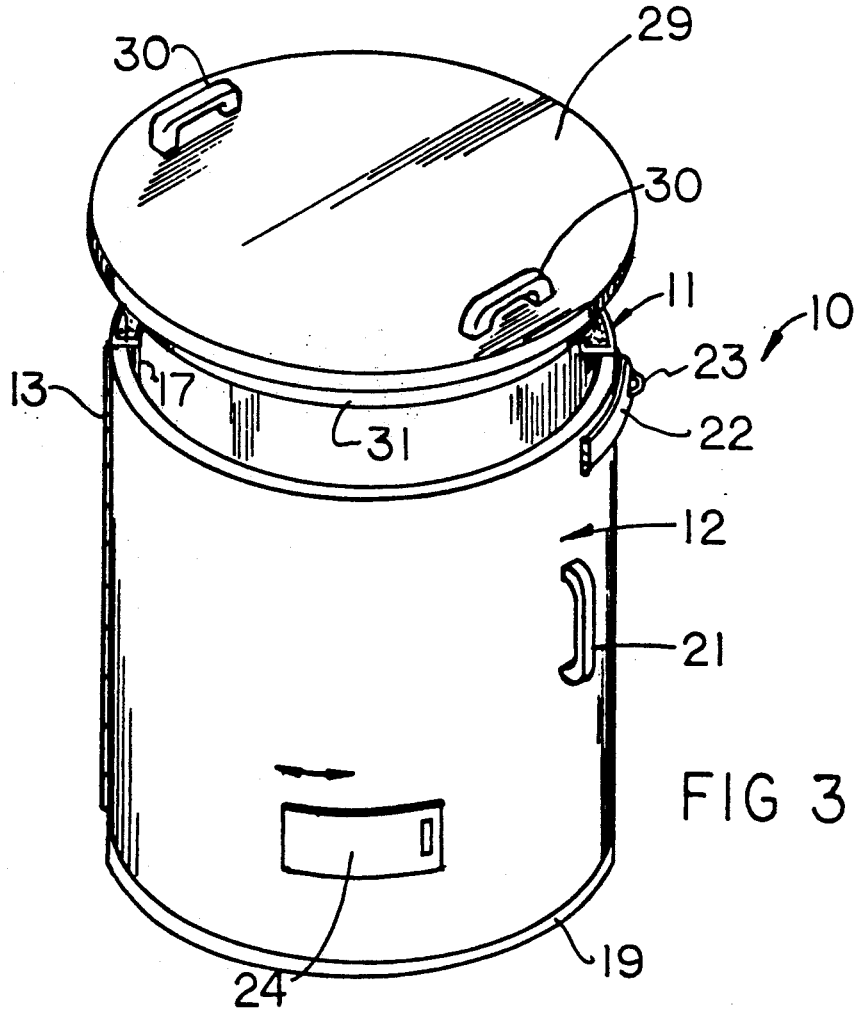
FIG. 3 is an isometric illustration of the invention in assembled configuration.
Figure 4:
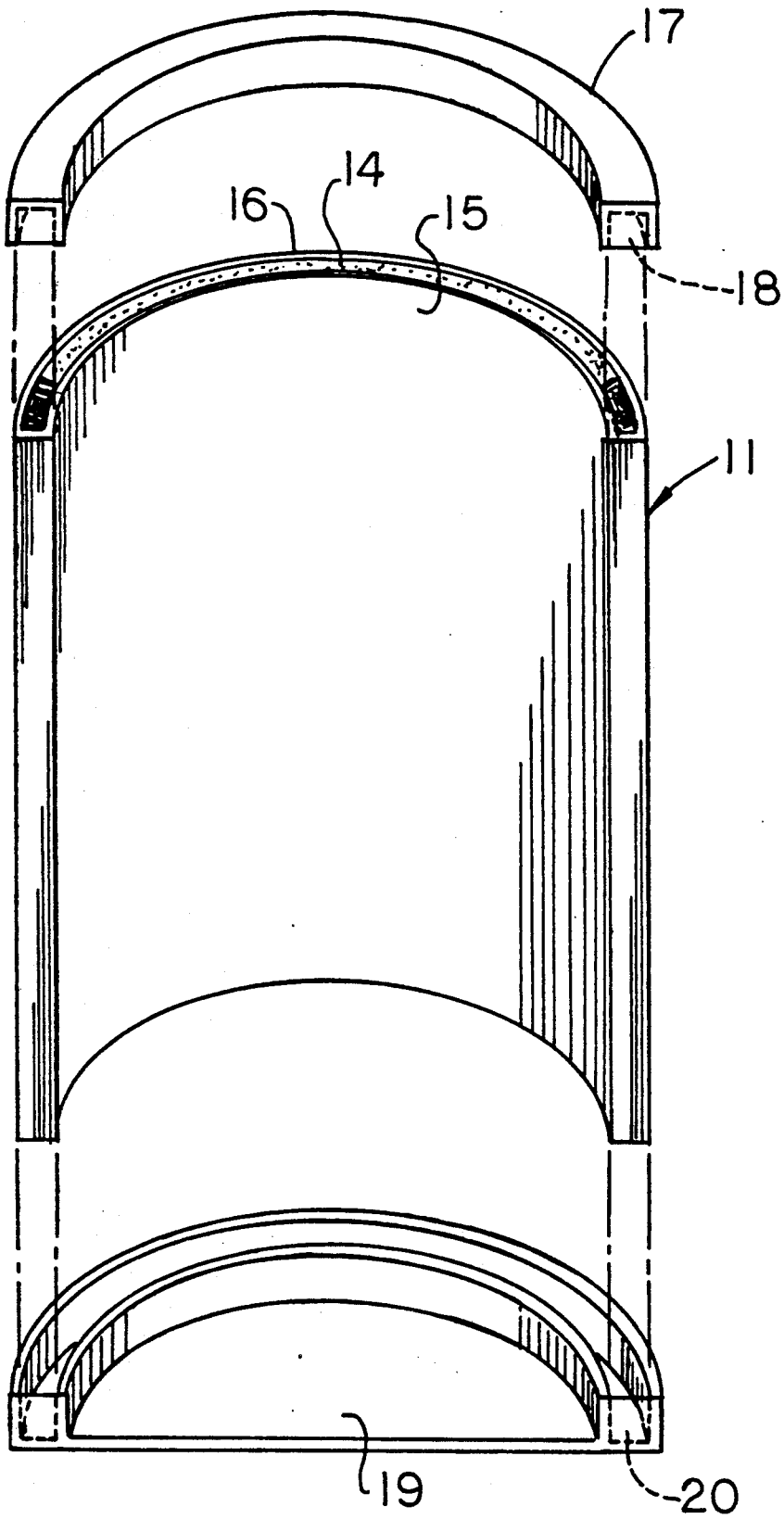
FIG. 4 is an isometric illustration of the first shell and the upper and lower caps relative thereto.
Figure 5:
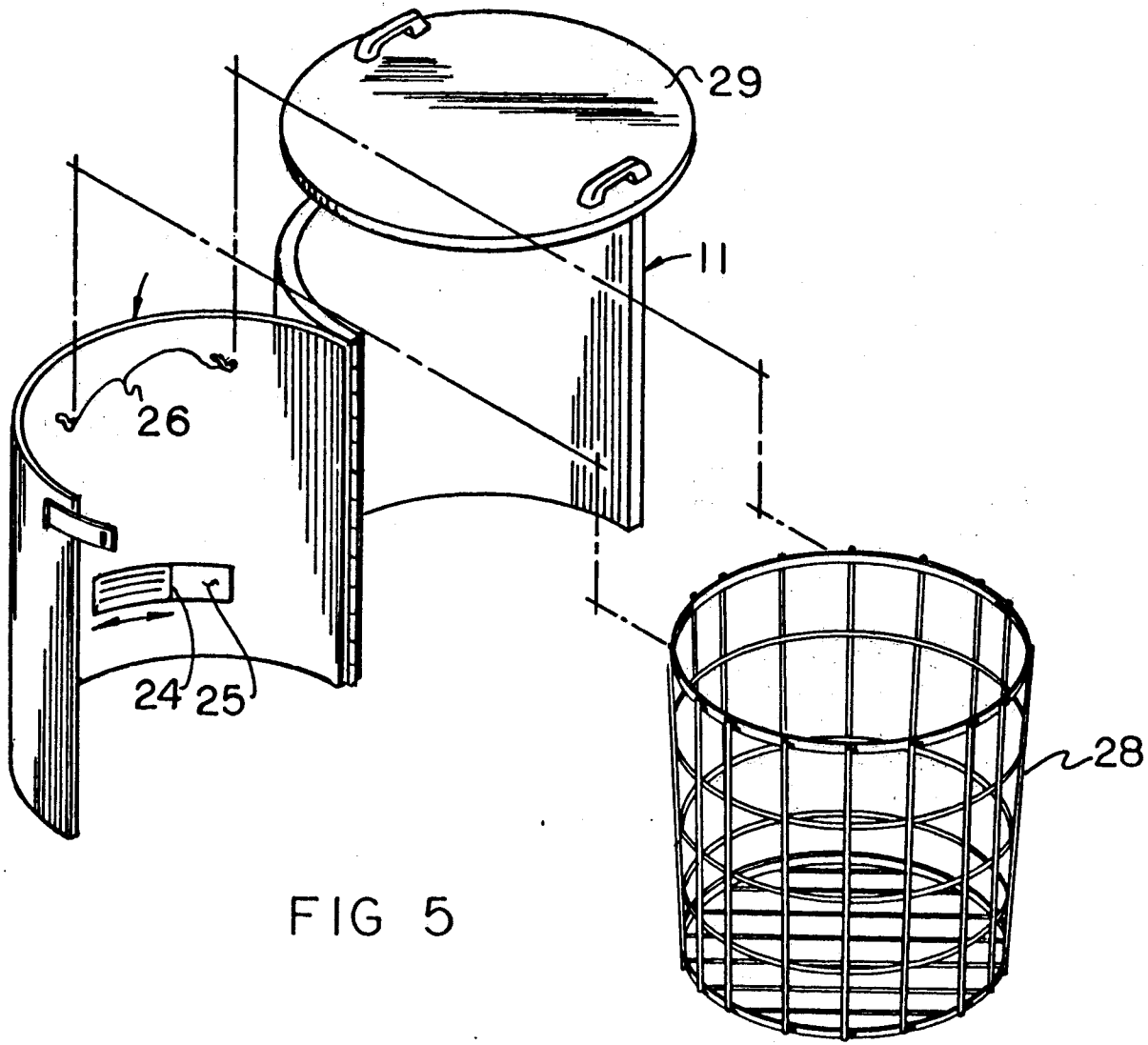
FIG. 5 is an isometric illustration illustrating the positioning of the mesh basket relative to the second shell.

More specifically, the refuse burner barrel apparatus 10 of the instant invention essentially comprises a semi-cylindrical first shell 11 hingedly mounted to a semi-cylindrical second shell 12 functioning as a door about a vertical hinge 13 mounting the first shell and the second shell 11 and 12 together in a hinged relationship to form a cylindrical barrel structure, such as illustrated in the FIG. 3. The first shell 11 includes an inner wall 15 spaced from an outer wall 16 to form a cavity filled with a powdered brick aggregate 14 to effect containment and reflection of heat interiorly of the barrel structure. A semi-cylindrical upper cap 17 is mounted coextensively to an upper distal end of the first shell as the upper cap 17 is formed with an upper "U" shaped channel 18 to receive the upper portion of the first shell 11 therewithin. The lower portion of the first shell 11 includes a cylindrical floor plate receiving the first and second shell lower distal ends thereon, but wherein the floor plate 19 further includes a semi-circular lower "U" shaped channel 20 that is aligned with and below the upper cap to receive the lower distal end portion of the first shell 11 therewithin to thereby contain the aggregate 14 within the first shell and provide for a unitary construction of the barrel during use.

The second shell or door 12 includes a second shell handle 21 mounted thereto. Further, a latch bar 22 hingedly mounted to the second shell extending beyond the second shell is arranged for reception of a latch bar ring 23 therewithin that in turn is mounted to the first shell to permit a latch member such as a paddle lock and the like to be directed through the ring 23 to secure the first shell relative to the secodn shell in the cylindrical configuration. A vent door 24 is slidably mounted through the door 12 overlying a vent opening 25 to effect selective opening and closing of the vent opening 25 providing for selective directing of draft through the barrel structure during use.

Hook members 26 are mounted fixedly adjacent an upper distal end portion of the second shell 12 to receive a mesh basket 28 thereon. In this manner, the mesh basket 28 is mounted to the hook members 26, whereupon opening of the door 12 simultaneously supports and transports the mesh basket with the door to permit ease of cleaning and access to the mesh basket that has received refuse during a burning procedure easing a cleaning procedure of the barrel structure.

A lid plate 29 of a circular configuration includes a plurality of lid plate handles 30 mounted to a top surface thereof, and further includes a cylindrical rib 31 projecting below the lid plate, as the cylindrical rib 31 is received within the first shell and second shell and is defined by a first diameter substantially equal to an internal diameter of the first and second shells when in a closed configuration.

The FIG. 1 illustrates the use of semi-circular cementious inserts 27 arranged for a stacked relationship that may be utilized in lieu of the powdered brick aggregate 14. It is contemplated that the powdered brick aggregate is arranged to more completely effect a filling of the cavity between the inner and outer walls of the first shell forming a more suitable refractory lining material.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A refuse burner barrel apparatus, comprising, a semi-cylindrical first shell and a semi-cylindrical second shell, the first shell and the second shell include a hinge hingedly mounting the first shell to the second shell, wherein the first shell and the second shell are arranged in a circular configuration in a first position, and wherein the second shell is displaced relative to the first shell when pivoted relative to the hinge to provide access to a burning cavity within the first shell and the second shell, and the first shell includes a first shell inner wall and a first shell outer wall concentric relative to one another and coextensive relative to one another to define a first shell cavity therebetween, wherein the first shell cavity includes a powdered brick aggregate coextensively directed throughout the first shell cavity.

2. An apparatus as set forth in claim 1 including a semi-cylindrical upper cap mounted to the upper distal end of the first shell, wherein the semi-cylindrical upper cap includes a "U" shaped channel to receive the first shell therewithin, and a semi-cylindrical lower channel coextensive with the first shell receiving the lower distal end of the first shell therewithin, and the lower cap fixedly mounted to a cylindrical floor plate, and the floor plate slidably receiving the second shell thereover.

3. An apparatus as set forth in claim 2 wherein the second shell includes a second shell handle, and a latch bar mounted to the second shell extending beyond the second shell wherein the latch bar is pivotally mounted to the second shell and includes a slot therethrough, and the first shell includes a ring mounted to the first shell and the ring is arranged for reception through the slot of the latch bar for securement of the first shell and the second shell together.

4. An apparatus as set forth in claim 3 including a vent door slidably mounted through the second shell, the vent door positioned over a vent opening through the second shell to effect selective closure of the vent opening by the vent door.

5. An apparatus as set forth in claim 4 including a plurality of hook members mounted to an interior surface of the second shell adjacent an upper distal end of the second shell, wherein the hook members project radially and interiorly of the burning cavity, and further including a mesh basket, the mesh basket mounted on the hook members.

6. An apparatus as set forth in claim 5 including a cylindrical lid plate, the cylindrical lid plate including a cylindrical rib mounted to a bottom surface of the lid plate, the cylindrical rib arranged for reception within the first shell and the second shell to effect choking of a burning fire within the first shell and the second shell.

7. An apparatus as set forth in claim 6 wherein the lid plate includes at least one handle member mounted to a top surface of the lid plate to permit ease of manual manipulation of the lid plate relative to the first shell and the second shell.

* * * * *